United States Patent [19]

Theurer et al.

[11] 4,186,804

[45] Feb. 5, 1980

[54] BALLAST EXCAVATING CHAIN ARRANGEMENT

[75] Inventors: Josef Theurer, Vienna; Karl Fulser, Linz-Urfahr, both of Austria

[73] Assignee: Franz Plasser Bahnbaumaschinen-Industriegesellschaft m.b.H, Vienna, Austria

[21] Appl. No.: 882,665

[22] Filed: Mar. 2, 1978

[30] Foreign Application Priority Data

Mar. 22, 1977 [AT] Austria ..... 1998/77

[51] Int. Cl.[2] ..... F01B 27/00

[52] U.S. Cl. ..... 171/16; 37/104; 104/7 R

[58] Field of Search ..... 171/16; 37/104–107; 104/7 R, 7 A, 7 B

[56] References Cited

U.S. PATENT DOCUMENTS

| | | | |
|---|---|---|---|
| 3,612,184 | 10/1971 | Plasser et al. | 171/16 |
| 3,685,589 | 8/1972 | Plasser et al. | 171/16 |
| 3,850,251 | 11/1974 | Plasser et al. | 171/16 |
| 3,957,000 | 5/1976 | Plasser et al. | 171/16 |
| 3,976,192 | 8/1976 | Plasser et al. | 171/16 |
| 4,014,389 | 3/1977 | Thevrer et al. | 171/16 |
| 4,043,398 | 8/1977 | Folser et al. | 171/16 |

*Primary Examiner*—Louis G. Mancene
*Assistant Examiner*—Paul J. Hirsch
*Attorney, Agent, or Firm*—Kurt Kelman

[57] ABSTRACT

A ballast excavation chain arrangement includes a polygonal chain guide and an endless ballast excavation link chain supported therein. The lower portions of two longitudinally extending guide sections are connected to respective ends of a transversely extending guide section and the latter guide section and a portion of the link chain is mounted for extension transversely of, and below, the track for excavating ballast. Hydraulic drives are provided for laterally adjusting at least the lower portions of the longitudinally extending guide sections for selectively extending the chain guide to the right and to the left of the track.

8 Claims, 8 Drawing Figures

BALLAST EXCAVATING CHAIN ARRANGEMENT

The present invention relates to improvements in a track working machine comprising a frame mounted for mobility on the track resting on ballast, such as a ballast cleaning machine useful for work not only in straight track but also in track switches, and more particularly to a ballast excavation chain arrangements in such machines.

Our U.S. Pat. No. 4,014,389, dated Mar. 29, 1977, and No. 4,043,398, dated Aug. 23, 1977, for example, disclose machines of this general type, comprising equipment for receiving ballast, cleaning it and redistributing the cleaned ballast, including a ballast excavation chain arrangement which includes a polygonal chain guide mounted on the machine frame and having two longitudinally extending guide sections and a transversely extending guide section, the longitudinally extending guide sections having respective lower portions connected to respective ends of the transversely extending guide section, and an endless ballast excavation link chain supported in the chain guide, the transversely extending guide section and a portion of the link chain therein being mounted for extension transversely of, and below, the track for excavating ballast. The ballast excavation link chain is trained over guide rollers or sprockets in the guide, and the chain guide may be swung laterally to project from either side of the frame transversely of the track. In this arrangement, the ballast is excavated by the link chain portion in the transversely extending guide section, transported by the link chain in one of the longitudinally extending guide sections to a ballast discharge station, and an empty portion of the link chain is returned without load in the other longitudinally extending guide section to the transversely extending guide section. A hydraulic drive is connected to the other longitudinally extending guide section in an upper third of the guide section remote from the transversely extending guide section for laterally adjusting the other longitudinally extending guide section so that the width of the transversely extending guide section may be selectively increased by inserting eight to nine guide members therein. In this manner, the transversely extending guide section may be sufficiently lengthened at the side of the other longitudinally extending guide section to enable a ballast region next to the track on this side to be worked, for instance in the range of a track switch where a branch line branches off the main track. This machine has been very successful since it enables ballast to be cleaned in a track switch with the same machine that is used for cleaning the ballast of a main line. However, if such a machine is used in rail yards or on track where branch lines successively branch off to the right and to the left, difficulties arise due to the fact that the ballast excavating region can be widened only towards one side of the track. Therefore, the machine must be turned by 180° to enable the work to proceed, which reduces the efficiency of the operation and makes work particularly difficult in cases where it must be done in relatively short intervals between passing trains.

It is the primary object of this invention to improve a ballast excavation chain arrangement of the indicated type to adapt it to rapid and effective work on all types of track, including work on two parallel tracks and branch lines to the left and right of a main track.

This and other objects are accomplished in accordance with the invention by connecting drive means to both longitudinally extending guide sections for laterally adjusting at least the lower portions thereof for selectively extending the chain guide to the right and to the left of the track, and movable guide section members in the transversely extending guide section and additional chain links for mounting in the ballast excavation link chain upon lateral adjustment of a selected one of the longitudinally extending guide sections whereby the width of the transversely extending guide section and corresponding link chain portion may be extended for excavating to the right and to the left of the track. Cleaned excavated ballast is redistributed to the right and to the left of the track selectively.

With a machine of this type, it is possible to excavate ballast under main track and selectively from a ballast region to the left and to the right of the main track. Thus, if a left switch follows a right switch, or vice versa, work with the machine may proceed without turning the machine by 180° and the ballast will be excavated not only from under the main track but from the respective switch area by lengthening the transverse section of the ballast excavation chain arrangement selectively. The laterally projecting parts of the arrangements may be readily guided by relatively simple support structures since the machine always moves along the main track.

The above and other objects, advantages and features of the present invention will become more apparent from the following detailed description of some now preferred embodiments thereof, taken in conjunction with the accompanying schematic drawing wherein FIG. 1 is a side elevational view of a mobile ballast cleaning machine incorporating a ballast excavation chain arrangement according to one embodiment of the invention;

Figure 1:
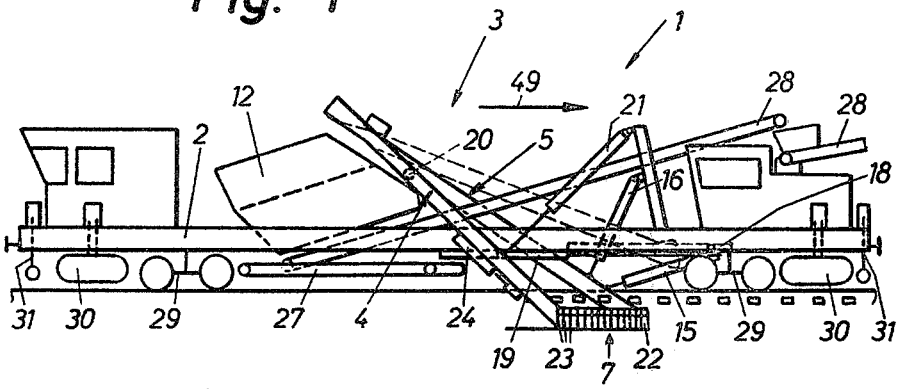
Figure 2:
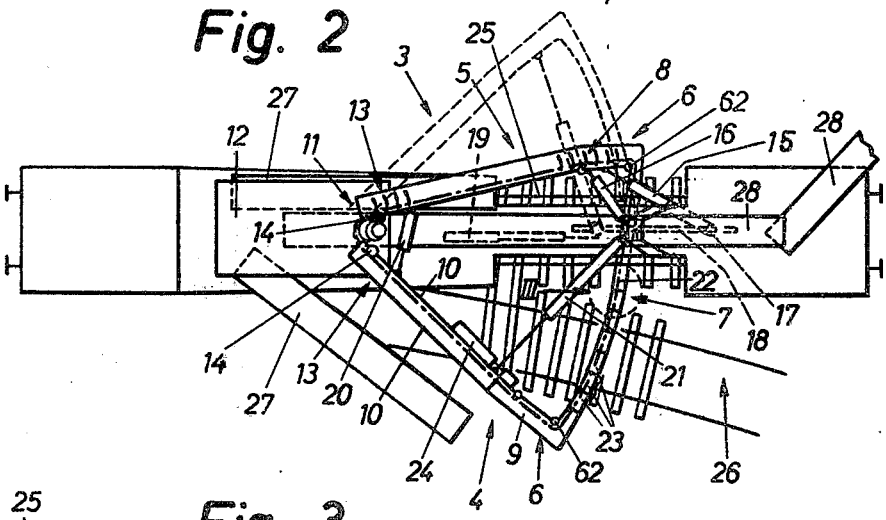
FIG. 2 is a top view of the machine of FIG. 1, shown working in a track switch.

Referring now to the drawing and first to FIGS. 1 and 2, there is shown mobile ballast cleaning machine 1 similar to that of our U.S. Pat. No. 4,043,398, whose entire disclosure is incorporated herein by way of reference. This machine comprises frame 2 which is supported on undercarriages 29 for mobility on the rails of track 25 in an operating direction indicated by arrow 49. Ballast excavation chain arrangement 3 is mounted on machine frame 2 to remove dirty ballast from the ballast bed on which the track rests, as well as from laterally adjacent regions on which a branch track may rest, such as shown by widening ballast bed region 26 at a track switch into which the machine moves. The ballast excavation chain arrangement comprises a polygonal chain guide comprised of two longitudinally extending chain guides 4 and 5 whose lower end portions 6 are connected by transversely extending chain guide 7. Each chain guide is trough-shaped and has a bottom 9 and side walls 10, endless excavation chain 8 moving in a triangular path in the trough-shaped chain guides about guide rollers or sprockets 62. The two longitudinal chain guides 4 and 5 rise from their ends 6 and transverse chain guide 7, which are immersed in the ballast during a ballast cleaning operation, to ballast discharge station 11, the excavation chain arrangement extending in a plane which is oblique to the track plane. Universal pivot 14 mounts upper ends 13 of the longitudinal chain guides on machine frame 2 to permit the excavation chain to be pivoted vertically as well as laterally on the frame. The excavated ballast is discharged onto ballast cleaning screen 12 subtending the upper ends of the chain guides.

Suitable drives illustrated as hydraulic motors 15 and 16 are linked, respectively, to machine frame 2 and longitudinal chain guide 5, along which the excavated ballast is moved to discharge station 11, to enable this chain guide to be adjusted laterally and vertically. Bearing 17 connects one end of hydraulic motor 15, which serves as the lateral adjustment drive, with machine frame 2, the illustrated connection being longitudinally extending guide 18 which receives bearing 17 and guides the same in the direction of the track elongation. Drive 19, which is also illustrated as a hydraulic motor, is linked to bearing 17 to move the same along guide 18. As shown in FIG. 2 in full and broken lines, this power drive arrangement enables chain guide 5 to be laterally adjusted between a position wherein it is capable of excavating ballast from under the track on which the machine moves (or even a further inward position during travel of the machine from one working site to another) to a laterally extended position (shown in broken lines) wherein ballast may be excavated from a laterally adjacent ballast region. While bearing 17 of hydraulic motor 15 is connected to the machine frame, the other end of the motor is linked to lower end 6 of chain guide 5, which greatly reduces the flexing forces exerted upon the chain guide during its lateral adjustment. This is particularly important because chain guide 5 carries not only the weight of chain 8 but also that of the excavated ballast which the chain carries to cleaning screen 12.

Longitudinal guide 4, along which the empty chain moves from ballast discharge station 11 towards the ballast bed, is similarly mounted for lateral and vertical adjustment by suitable power drives illustrated as hydraulic motors 20 and 21. The ends of hydraulic motors 20 and 21 are respectively linked at fixed pivots to machine frame 2 and to chain guide 4. Lateral adjustment drive 20 is linked to upper end 13 of the chain guide and is preferably used for laterally adjusting the chain guide only when it is required to move chain guide 4 with respect to transverse chain guide 7 so as to make it possible to insert or remove chain guide component members 23 whose number determines the width of the transverse chain guide. The manner of this assembly has been more fully described in our U.S. Pat. No. 4,014,389, whose entire disclosure is incorporated herein by way of reference. As aslo fully described in this patent, longitudinal chain guide 4 is comprised of two parts movable in relation to each other in the direction of chain elongation and interconnected by hydraulic motor 24 to adjust the effective length of the chain guide and to tension the excavation chain.

Portion 22 of transverse chain guide 7 has a length corresponding substantially to the width of a track bed to enable the chain to excavate ballast under track 25 on which the machine moves. By inserting a suitable number of guide component members 23 (and corresponding numbers of links in excavation chain 8), the transverse chain arrangement portion may be lengthened to assume the width shown in FIG. 2 so that ballast may also be excavated from widening ballast bed 26. As shown in the drawing, successive component chain guide members 23 are inclined at a small angle of about 3° to their preceding guide members in the direction of the upper ends 13. In this manner, the distance between lower ends 6 of longitudinal chain guides 4 and 5 in the direction of track elongation is bridged, this distance being due to the lateral outward movement of longitudinal chain guide 4.

As has been shown in broken lines in FIG. 2, the lengthening of transverse chain guide 7 may be effected in either lateral direction, i.e. by laterally adjusting chain guide 4 by power drive 20 or chain guide 5 by power drive 15. In this manner, branch tracks to the right or the left of main track 25 may be worked by the machine at a switch.

Fixed portion 22 of transversely extending chain guide 7 has a length sufficient to enable a portion of the excavation link chain therein to receive and excavate the ballast under track 25. Removable guide section members 23 and chain links 32, respectively, may be mounted in the transversely extending guide section and the ballast excavation link chain upon lateral adjustment of a selected one of longitudinally extending guide sections 4 and 5 whereby the width of guide section 7 and corresponding link chain portion may be varied for excavating ballast to the right and to the left of the track at the same time as that under the track itself, as shown in FIG. 2 in connection with lateral ballast region 26 at a track switch. As also shown in this figure, the abutting ends of inserted guide members 23 are inclined to each other by a small angle of the order of about 3°. In this manner, the distance between the lower end portions 6 of longitudinally extending guide sections 4 and 5 in the direction of track elongation, due to the lateral adjustment of guide section 4, is bridged. As shown in broken lines in FIG. 2, the same lateral adjustment may be effected with respect to guide section 5 by operation of drive 15.

As illustrated, the longitudinally extending guide sections are preferably mounted for lateral adjustment of the lower portions thereof by a distance corresponding to at least a length of a track tie and, preferably, respective center portions thereof have a minimum distance corresponding to at least one track tie length in a direction transverse to the track. This enables the machine to be used for the simultaneous working of track 25, on which it moves, and a track running parallel thereto to the right or to the left thereof. In addition, the center spacing of the two longitudinally extending guide sections makes it possible to use this arrangement also in track renewal machines, with which an old track is removed and a new track laid, the track components being displaceable through the space enclosed by the polygonal excavation chain arrangement.

Vibratory ballast cleaning screen 12 is mounted on machine frame 2 to subtend discharge station 11 of ballast excavation chain arrangement 3 and the ballast cleaned on the screen is received by pivotal conveyor bands 27 for redistribution in the ballast bed selectively to the right and to the left of the track while the waste coming from screen 12 is removed by conveyor band system 28 in the manner more fully described in the above named patents. The pivoting range of conveyor bands 27 suffices to redistribute the cleaned ballast even at the maximum extension of transverse guide section 7.

Machine frame 2 also has retractable tracked undercarriages 30, 30 and auxiliary bogies 31, 31 are mounted at the ends of the frame to enable ballast cleaning machine to move not only on the track by means of undercarriages 29, 29 but also on trackless ballast bed regions by means of tracked undercarriages 30, 30.

Figure 3:
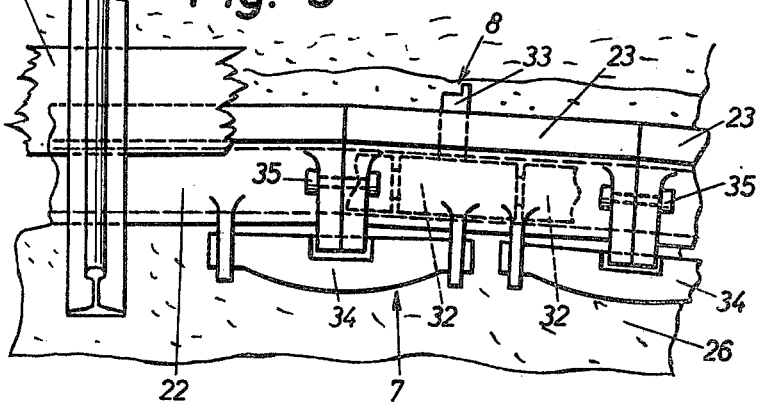
FIG. 3 is an enlarged front view of the transverse section of the ballast excavation chain arrangement immersed in the ballast.

FIG. 3 shows a part of the transverse section 7 immersed in the ballast of lateral ballast bed region 26, abutting ends of fixed guide section portion 22 and removable guide section members 23 enclosing a small angle with each other. As is illustrated in FIG. 1, this enables the excavation plane to remain even despite the oblique arrangement of the bottoms of the trough-shaped guide section portions and the curved path of section 7. The slightly angular relationship of the transverse guide section members to each other does not interfere with the proper guidance of excavation link chain 8 comprised of chain links 32.

Since the chain is arranged not only for loosening and excavating ballast but also for transporting the ballast in chain guide section 5 to the discharge station and screen 12, every other chain link has an excavating bucket 33 which may have excavating fingers of hard metal.

The transverse guide section portions 22 and 23 are coupled together guide elements 34 whose dove-tailed lugs engage correspondingly dove-tailed guides at the abutting ends of the portions. The portions are detachably affixed to each other by screw bolts 35.

Figure 4:
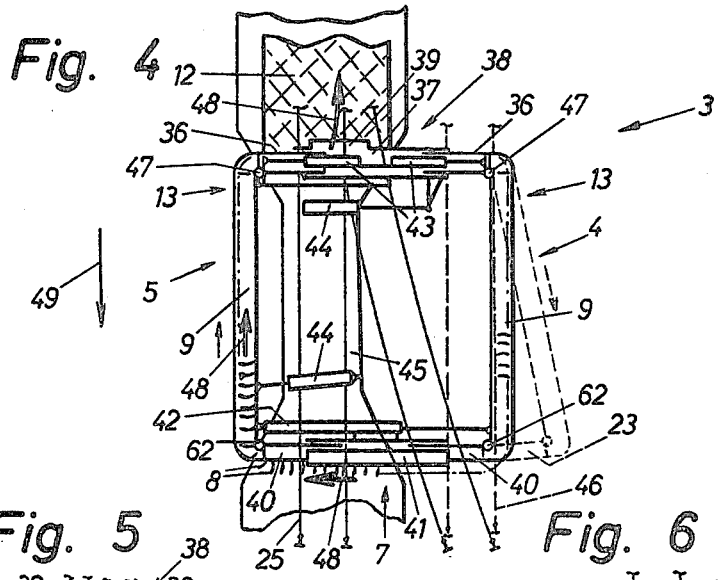
FIGS. 4 to 8 are diagrammatic top views of additional embodiments of the arrangement according to this invention.

FIG. 4 shows a ballast excavation chain arrangement 3 with trough-shaped chain guide sections having a bottom 9 and wherein the drive means are connected to the longitudinally extending guide sections 4 and 5 in respective end portions 6 and 13 thereof for lateral adjustment in the planes of the bottoms. In the illustrated embodiment, further transversely extending guide section 38 connects upper portions 13 of the longitudinally extending guide sections and the further transversely extending guide section includes ballast discharge station 39 for depositing ballast on vibratory ballast cleaning screen 12. The illustrated guide section 38 is comprised of two telescoping through-shaped portions 36, 37 and transversely extending guide section 7 also comprises several telescoping portions 40, 41 for adjustment of the width of the transversely extending guide section. Drive means shown as hydraulic motor 42 is connected to both longitudinally extending guide sections 4 and 5 for laterally adjusting the lower portions thereof and another such drive means 43 also illustrated as a hydraulic motor is connected between telescoping portions 36 and 37 of further transversely extending guide section 38. In the illustrated embodiment, an additional lateral adjustment drive 44 also consisting of a hydraulic motor has one end linked to machine frame part 45 while its other end is linked to guide section 5 to enable this guide section to be fixed as a predetermined distance from machine frame part 45. Upper ends portions 13 of longitudinally extending guide sections 4 and 5 are mounted for pivoting about axis 47 extending substantially perpendicular to bottoms 9 of the longitudinally extending guide sections to enable the width of transversely extending guide section 7 to be increased sufficiently (see broken lines) to work simultaneously main track 25, on which the machine moves, and parallel track 46. If the telescoping guide section portions 40 and 41 are not long enough for the full extension of guide section 7, removable guide section members 23 may be inserted.

As the machine proceeds along track 25 in the operating direction indicated by arrow 49, ballast is excavated and transported in the direction of arrow 48 to be taken along guide section 5 to discharge station 39.

The linear lateral adjustment of the longitudinally extending guide sections has the advantage of providing for a linear extension of the transverse guide section. In addition, the provision of an upper transversely extending guide section provides additional space within the excavation chain arrangement to make it possible to transport track parts therethrough when the arrangement is used in a track renewal operation. Connecting the lateral adjustment drive means to the end portions of the longitudinally extending guide sections reduces the flexing moment on the guide sections during adjustment. The arrangement of the upper transverse guide section makes it possible favorably to distribute the ballast discharge onto the cleaning screen. In view of the rough operating conditions and high loads to which the components of the excavation chain arrangement are subjected, it will be useful to provide suitable guide tracks or rods for the moving component parts to facilitate the maintenance and increase the working life of the component parts.

Figure 5:
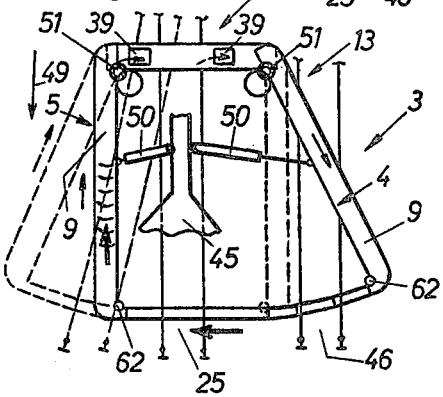

To avoid redundancy in the description, like reference numerals designate like parts operating in a like manner in the embodiment of FIG. 5. As in the embodiment of FIG. 4, guide sections 4 and 5 are mounted for pivoting about axes 51 extending substantially perpendicular to bottoms 9 of the trough-shaped guide sections, the two guide sections being laterally adjustable independently of each other by respective drive means 50,50. This embodiment provides relative space economy in the upper portion of the chain guide and only the lower transverse guide section is widened in case of need. The separate lateral adjustment drives make it possible not only to change the width of the lower transverse chain guide but also to pivot the longitudinally extending guide sections to position them laterally in a desired position during the ballast cleaning operation.

Figure 6:
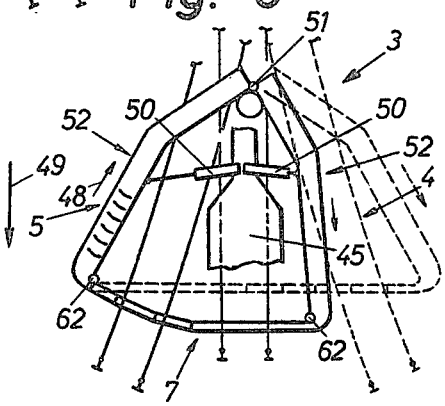

In FIG. 6, the same reference numerals again designate like parts operating in a like manner but, in contrast to the embodiments of FIGS. 4 and 5 wherein arrangement 3 is quadrangular, excavation chain arrangement 3 of the embodiment of FIG. 5 is pentagonal. Each longitudinally extending guide section 4, 5 may be laterally adjusted independently by a distance corresponding to at least one tie length. When only guide section 5 is laterally adjusted, as shown in full lines, transverse guide section 7 takes a curved path. When a three-way switch is to be worked, for example, both longitudinally extending guide sections are laterally adjusted, as shown in broken lines, and the transverse guide section is rectilinear. A portion of the side wall of trough-shaped guide section 5 is removed near or at the top of the arrangement to discharge the ballast. While separate drive sprockets are provided at each pivoting axis 51 in the embodiment of FIG. 5, a single drive sprocket for the excavating chain is mounted at the pivoting axis 51 in the embodiment of FIG. 6.

Figure 7:
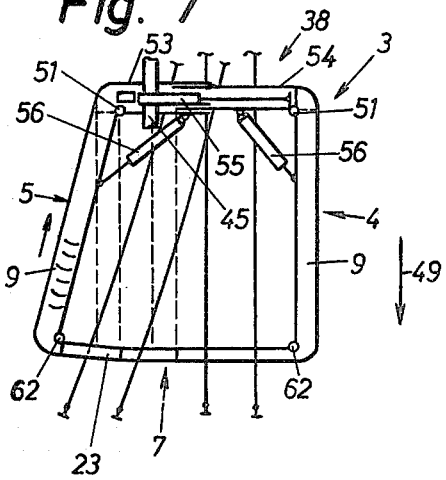

In the embodiment of FIG. 7, as in that of FIG. 4, longitudinally extending guide sections 4 and 5 are not only rectilinearly displaceable transversely to the machine frame but are also laterally pivotal about perpendicular axes 51. For this purpose, upper transverse guide section is comprised of two telescoping trough-shaped guide section portions 53 and 54 connected to lateral adjustment drives 55 of which only one has been shown. Pivoting drives 56 are connected between guide section portions 53, 54 and guide sections 4, 5, respectively, to enable the guide sections to be pivoted about axes 51. Transverse guide section 7 may be extended by insertion of guide members 23.

Figure 8:
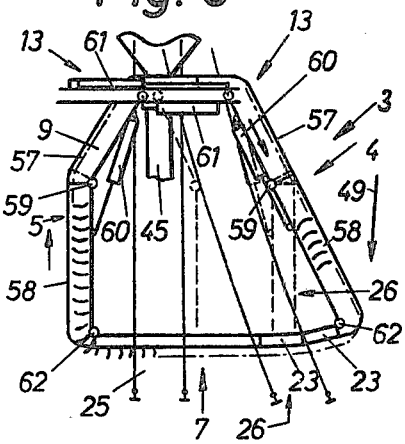

In the embodiment of FIG. 8, each of the longitudinally extending guide sections 4, 5 consists of two pivotally connected portions 57 and 58, the two portions being mounted for pivoting about a respective axis 59 extending substantially perpendicular to bottoms 9 of the two portions. A separate drive means 60 illustrated as a hydraulic motor is arranged to pivot the two portions of each guide section relative to each other about the axis. The upper end portions of longitudinally extending guide sections 4 and 5 are supported in guide tracks or on guide rods for displacement transversely to the longitudinal extension of the machine, nhydraulic drives 61 being linked to machine frame part 45 and respective upper end portions 13 of the guide sections for displacing the guide section upper end portions rectilinearly for lateral adjustment thereof.

This arrangement makes it possible to adjust the excavation width most sensitively to prevailing operating conditions while requiring only relatively short strokes of the adjustment drives. Where the longitudinally extending guide sections are not only rectilinearly laterally displaceable but also pivotal for lateral adjustment, considerable adjustments of the excavation width up to covering two parallel tracks may be achieved without unfavorably influencing the position of the transverse excavating section. Where separate drives for the lateral adjustment of the longitudinally extending guide sections are provided, a single-cylinder hydraulic motor may be used for the drives. When the two longitudinally extending guide sections are laterally adjustable in unison with the transversely extending guide section, the entire excavation chain arrangement may be swung over during a ballast cleaning operation without changing its excavation width, for instance to avoid fixed obstacles in the path of the machine.

If the transverse guide sections are comprised of telescoping portions constituting the movable guide section members, it will not be necessary to carry along removable guide section members for insertion in the guide section upon adjustment of its width and, furthermore, this width may be adjusted steplessly and almost continuously as the width of excavation is gradually increased or reduced. This considerably decreases operating time needed for inserting and/or removing such members and correspondingly increases the efficiency of the machine.

Obviously, the lateral adjustment drive means may take any suitable form, such as cable drives or spindle drives although hydraulic motors have been specifically described and illustrated by way of example. Also, the lower end regions 6 of longitudinally extending guide sections 4 and 5 are linked to the respective ends of transversely extending guide section 7 for pivoting about axes 62 extending perpendicular to bottoms 9 of the trough-shaped guide sections.

In the embodiment of FIGS. 1 and 2, guide 18 may be suitably modified by providing cable drives or roller and track guide arrangements, or the like. If lateral adjustment drive has a small stroke, it may be fixedly arranged on a lever arrangement movable in the longitudinal direction of the machine and laterally adjustable or it may be pivotal in relation thereto by a power drive.

While the machine has been described as movable on track 25, it should be understood that this includes moving the machine along the right or way defined by track 25 directly on the ballast bed, for which purpose the tracked undercarriages 30, 30 are extended for support of the machine frame on the ballast bed. In either case, the machine is capable of excavating the ballast thereunder as well as to the right and/or the left of the machine.

What is claimed is:

1. In a track working machine comprising a frame mounted for mobility on the track having ties resting on ballast: a ballast excavation chain arrangement including (a) a polygonal chain guide mounted on the frame and having two longitudinally extending guide sections and a transversely extending guide section, the chain guide sections being trough-shaped and having a bottom, (1) the longitudinally extending guide sections having respective lower portions connected to respective ends of the transversely extending guide section, and (2) the longitudinally extending guide sections being so mounted that respective center portions thereof have a minimum distance corresponding to at least a length of a track tie in a direction transverse to the track and being mounted for lateral adjustment of the lower portion thereof independently of each other by a distance corresponding to at least a length of a track tie, (b) an endless ballast excavation link chain supported in the chain guide, (1) the transversely extending guide section and a portion of the link chain therein being mounted for extension transversely of, and below, the track for excavating ballast, (c) drive means separately connected to each one of the longitudinally extending guide sections in respective end portions thereof for laterally adjusting the end portions in the planes of the bottoms for selectively and independently extending a respective one of the chain guides to the right and to the left of the track for at least the length of a track tie, (d) guide section members detachably connecting the transversely extending guide section and the lower portions of the longitudinally extending guide sections, and (e) ballast conveyor means adjustable for redistributing cleaned excavated ballast in the ballast bed selectively to the right and to the left of the track.

2. In the track working machine of claim 1, the longitudinally extending guide sections having upper portions opposite to the lower portions, and further comprising a further transversely extending guide section connected to the upper portions, the further transversely extending guide section including a ballast discharge station, and the drive means being arranged for lateral adjustment of the lower and upper portions of the longitudinally extending guide sections.

3. In the track working machine of claim 1, means for mounting upper portions of the longitudinally extending guide sections opposite the lower portions thereof for pivoting about an axis extending substantially perpendicular to the longitudinally extending guide sections, and each a separate drive each of the longitudinally extending guide sections, each drive being connected between the frame and the respective guide section.

4. In the track working machine of claim 1, each of the longitudinally extending guide sections consisting of two pivotally connected portions, and further comprising means for mounting the two guide section portions for pivoting about an axis extending substantially perpendicular to the two portions, and the separate drive means for each of the longitudinally extending guide being arranged for pivoting the two portions relative to each other about the axis.

5. In the track working machine of claim 1, the longitudinally extending guide sections being trough mounted for pivoting about an axis extending substantially perpendicular to the bottoms thereof and being movable in a direction transverse to the frame.

6. In the track working machine of claim 1, the longitudinally extending chain guide sections being laterally adjustable in unison with the transversely extending chain guide.

7. In the track working machine of claim 1, the transversely extending guide section comprising telescoping portions for adjustment of the width of the transversely extending guide section.

8. In the track working machine of claim 1, the drive means comprising at least one drive having one end connected to the frame, the one drive end being adjustable in relation to the frame in a longitudinal direction extending in the direction of the track, and power drive means for adjusting the one drive end.

* * * * *

UNITED STATES PATENT AND TRADEMARK OFFICE

CERTIFICATE OF CORRECTION

PATENT NO. : 4,186,804

DATED : Feb. 5, 1980

INVENTOR(S) : Josef Theurer and Karl Fölser

It is certified that error appears in the above-identified patent and that said Letters Patent are hereby corrected as shown below:

Page 1, at [75], change "Fulser" to --Fölser--

Signed and Sealed this

Sixth Day of May 1980

[SEAL]

Attest:

SIDNEY A. DIAMOND

Attesting Officer

Commissioner of Patents and Trademarks